US006427787B1

(12) United States Patent
Jäger

(10) Patent No.: US 6,427,787 B1
(45) Date of Patent: Aug. 6, 2002

(54) DRILLING MOTOR THAT OPERATES PURSUANT TO THE MOINEAU PRINCIPLE FOR DRILLING DEEP HOLES

(75) Inventor: Sebastian Jäger, Hannover (DE)

(73) Assignee: Artemis Kautschuk-und Kunststoffechnik GmbH & Cie (DE)

( * ) Notice: Subject to any disclaimer, the term of this patent is extended or adjusted under 35 U.S.C. 154(b) by 0 days.

(21) Appl. No.: 09/602,752

(22) Filed: Jun. 23, 2000

(30) Foreign Application Priority Data

Jun. 24, 1999 (DE) ..... 299 11 031 U

(51) Int. Cl.[7] ..... E21B 4/02

(52) U.S. Cl. ..... 175/107; 175/100; 418/48

(58) Field of Search ..... 175/92, 500, 107; 418/48

(56) References Cited

U.S. PATENT DOCUMENTS 5,221,197 A * 6/1993 Kochnev et al. ..... 418/48

* cited by examiner

*Primary Examiner*—William Neuder
(74) *Attorney, Agent, or Firm*—R W Becker & Associates; R W Becker

(57) ABSTRACT

The drilling motor is provided that operates pursuant to the Moineau principle for drilling deep holes or wells in the ground. A helically extending rotor is disposed in a stator having a rigid shell that is provided on the inside with an inwardly helically extending lining of elastomeric material for receiving the rotor. The shell has essentially cylindrical end sections having an inner thread for securement of connection elements of the drilling motor. The portion of the shell disposed between the end sections extends helically in conformity with the lining such that at least the lining has an essentially uniform thickness over the length of this portion, which has an outer diameter that is less than that of the end sections. Between the end sections, the shell has a thickness that is less than that of the end sections.

13 Claims, 1 Drawing Sheet

DRILLING MOTOR THAT OPERATES PURSUANT TO THE MOINEAU PRINCIPLE FOR DRILLING DEEP HOLES

BACKGROUND OF THE INVENTION

The present invention relates to a drilling motor, such as a downhole drilling motor, that operates pursuant to the Moineau principle for drilling deep holes or wells in the ground. A helically extending rotor is disposed within a stator, and the rigid shell of the stator is provided with an inwardly helically extending lining of elastomeric material for receiving the rotor, wherein the shell is provided with essentially cylindrical end sections having a preferably slightly conical inner thread for the securement of connection elements of the drilling motor.

With heretofore known drilling motors of this type, the shell of the stator is cylindrical on the outside; the outer diameter of the end sections corresponds to the diameter of the portion that is disposed between them and that surrounds the elastomeric lining. As a consequence, very different thicknesses result for the elastomeric lining over the length of the stator; these differing thicknesses represent an unnecessary material expense for the elastomer, which in addition is unfavorably stressed.

It is therefore an object of the present invention to at least to a large extent eliminate these drawbacks, and in addition to also preclude drawbacks that result during the operation of the drilling motor upon return of the pressurized drilling fluid.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

The drilling motor of the present invention is characterized primarily by the following features:

a. the rigid shell of the stator extends helically in conformity with the inner spiral of the lining such that over the active length of the stator the lining has an at least essentially uniform thickness;

b. that portion of the stator disposed between the two end sections has an outer diameter that is less than that of the end sections; and c. the rigid shell has a thickness that is less than the thickness of the end sections.

Expediently, the rigid shell additionally merges with the end sections via a continuously increasing thickness and in an essentially conical manner.

Since now not only the lining but also the shell of the stator extend helically, each with an approximately uniform thickness over the length of the stator, a uniform stressing of the lining is achieved, and in particular accompanied by the utilization of as little material as possible. The aforementioned different diameters thus have the advantageous effect that the resistence to returning flow of the drilling fluid and the like is considerably reduced. Although the end sections do result in a throttling or restriction, their length is relatively short. The thin wall thicknesses of the portions bring about not only an improved processing during manufacture of the stator, they also have the effect that the outer diameter in the region between the two end sections can be comparatively small.

Further specific features of the present invention will be described in detail subsequently.

DESCRIPTION OF PREFERRED EMBODIMENTS

Figure 1:
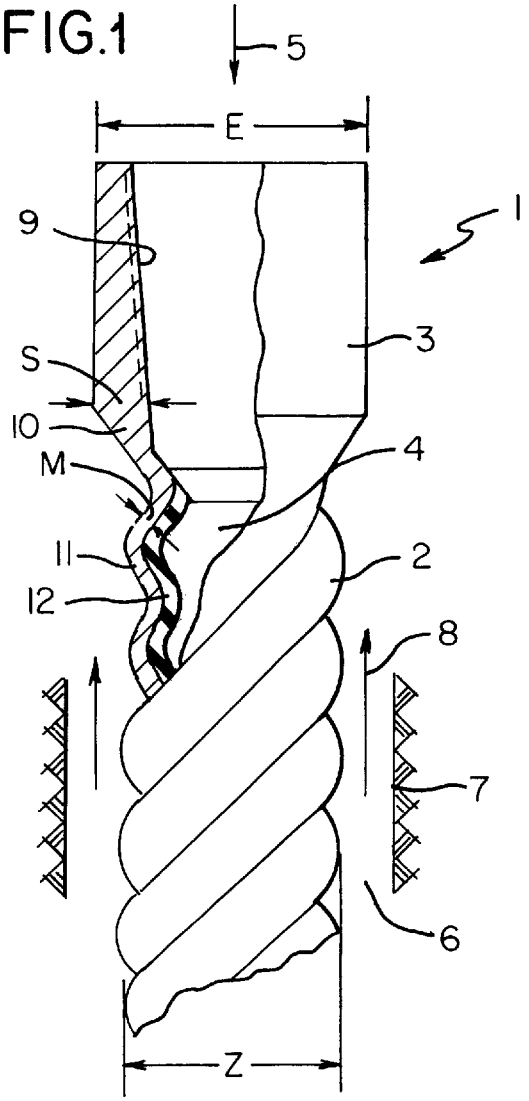
FIG. 1 is a partially cross-sectioned view through one exemplary embodiment of an inventive stator for a drilling motor for drilling deep holes in the ground.

Referring now to the drawing in detail, the drilling motor that is shown in FIG. 1, and that operates pursuant to the Moineau principle, is provided with a stator 1 that essentially comprises the active central portion 2 and the two end sections 3. The rotor, which in a manner known per se is eccentrically mounted, extends beyond the stator 1 at the bottom where via a coupling it drives the drilling tool, and ends in the upper end section of the stator 1. Since not only the interior 4 of the stator 1, but also the rotor, are helical on the outside, for example, five spirals for the stator 1 and four spirals for the rotor, the rotor is set into rotation when the pressurized or comprised drilling fluid is supplied in the direction of the arrow 5. This fluid finally leaves the motor, and is returned in the direction of the arrow 8 in the annular space 6 between the stator 1 and the inner wall 7 of the borehole.

The end sections 3 are cylindrical on the outside and have a diameter E; they also have a slightly conical inner thread 9 for threading on connection elements, such as a casing. The thickness of the end section 3 is indicated by the reference symbol S.

The end sections 3 merge with the portion 2 via an intermediate portion 10, which is tapered such that its thickness decreases in a direction toward the portion 2, i.e. the rigid shell 11 thereof. The shell 11 is provided with a lining 12 of rubber or rubber-like material; the lining 12 is preferably adhesively secured, and defines the actual working space of the drilling motor. The lining advantageously has the same thickness over the length of the portion 2.

The outer diameter Z of the portion 2 is considerably less than the diameter E of the end sections 3. Generally, the diameter E is about 10–25 mm greater than the diameter Z. At the same time, however, the portion 2 also has a comparatively small thickness M. The value of the thickness S can be 1.5–3 times greater than the thickness M for the shell 11.

It is furthermore important that the two end sections 3, together with the shell 11, be a monolithic component.

It is to be understood that the uniform thickness of the lining 12 leads to a savings in material and also to a uniform stressing of the material. Not only the small thickness M but also the reduced diameter Z have the great advantage that a large annular space 6 can result in order to be able to correspondingly intensify the return flow. The reduction of the thickness, however, also has the advantage that a deformability of cylindrical parts for forming a spiral is considerably facilitated. The conical intermediate portion 10 additionally forms, with regard to strength, a favorable transition between the regions of different diameter and different thicknesses.

Figure 2:
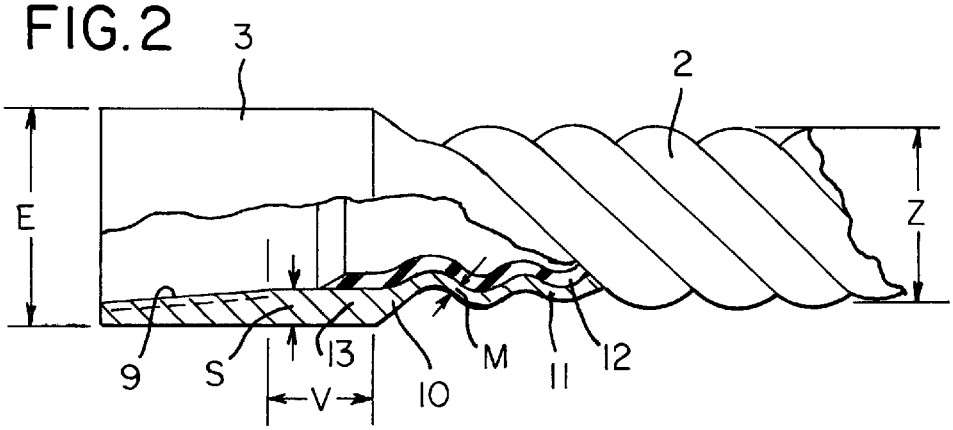
FIG. 2 is a modified embodiment of an inventive stator.

In the embodiment illustrated in FIG. 2, a cylindrical portion 13 having a length V is disposed on the end sections 3 between the intermediate portion 10 and the length of the end sections 3 that are provided with the inner thread 9. The cylindrical portion 13 is cylindrical both on the inside as well as on the outside, and at this location defines the thickness S. The important thing is that the lining 12 extends approximately over half of the length of the value V and is here, at its conically terminating end, adhesively secured.

Under these conditions, it is expedient if the outer diameter Z is about 85–95% of the value E. The dimension M should be about 35–75% of the value S.

The specification incorporates by reference the disclosure of German priority document 299 11 031.1 of Jun. 24, 1999.

The present invention is, of course, in no way restricted to the specific disclosure of the specification and drawings, but also encompasses any modifications within the scope of the appended claims.

What I claim is:

1. A drilling motor that operates pursuant to the Moineau principle for drilling deep holes or wells in the ground, comprising:

a helically extending rotor disposed in a stator having a rigid shell that is provided on the inside with an inwardly helically extending lining of elastomeric material for receiving the rotor, wherein the shell is provided with essentially cylindrical end sections having an inner thread for securement of connection elements of said drilling motor, wherein a portion of said shell disposed between said end sections extends helically in conformity with said lining such that at least said lining has an essentially uniform thickness over the length of said shell portion, and wherein said shell, between said end sections, has a thickness that is less than that of said end sections, with an average thickness of said end sections being approximately 1.5–3 times greater than said thickness of said shell.

2. A drilling motor according to claim 1, wherein said inner thread of said end sections is slightly conical.

3. A drilling motor according to claim 1, wherein said shell also has an essentially uniform thickness.

4. A drilling motor according to claim 1, wherein said rigid shell merges with said end sections via respective portions that in a direction toward said end sections have a continuously increasing diameter, making this portion conical, and an increasing thickness.

5. A drilling motor according to claim 1, wherein said diameter of said end sections is about 10–30 mm greater than said diameter of said portion of said shell disposed between said end sections.

6. A drilling motor according to claim 1, wherein said end sections on the one hand, and said helically extending shell disposed between them on the other hand, form a monolithic component.

7. A drilling motor according to claim 1, wherein said end sections are each provided with a cylindrical portion that is disposed between that part of said end section provided with said inner thread, and an intermediate portion that leads to said helically extending shell, wherein said cylindrical portion is cylindrical on both the inside as well as the outside.

8. A drilling motor according to claim 7, wherein said lining extends over at least a portion of said cylindrical portion.

9. A drilling motor according to claim 8, wherein said lining has a conically terminating end that is adhesively secured to said cylindrical portion.

10. A drilling motor according to claim 8, wherein said lining extends at least essentially over half of the length of said cylindrical portion.

11. A drilling motor according to claim 1, wherein said outer diameter of said portion of said shell disposed between said end pieces is at least essentially 85–95% of said outer diameter of said end sections.

12. A drilling motor according to claim 1, wherein said thickness of said shell disposed between said end sections is approximately 35–75% of said thickness of said end sections.

13. A drilling motor according to claim 1, wherein said shell portion has an outer diameter that is less than that of said end sections.

* * * * *

UNITED STATES PATENT AND TRADEMARK OFFICE

CERTIFICATE OF CORRECTION

PATENT NO. : 6,427,787 B1
DATED : August 6, 2002
INVENTOR(S) : Jäger, Sebastian

It is certified that error appears in the above-identified patent and that said Letters Patent is hereby corrected as shown below:

Title page,
Item [73], should read as follows:
-- [73] Assignee: Artemis Kautschuk-und Kunststofftechnik GmbH & Cie (DE) --

Signed and Sealed this

Tenth Day of December, 2002

JAMES E. ROGAN
*Director of the United States Patent and Trademark Office*